United States Patent [19]

Ottmann et al.

[11] 4,042,315

[45] Aug. 16, 1977

[54] APPARATUS FOR MAKING CONCRETE PIPE

[75] Inventors: Norman Ottmann, Simsbury; Walter Strever, Cromwell, both of Conn.

[73] Assignee: Atlantic Pipe Corporation, Plainville, Conn.

[21] Appl. No.: 635,980

[22] Filed: Nov. 28, 1975

Related U.S. Application Data

[62] Division of Ser. No. 547,333.

[51] Int. Cl.[2] ..... B28B 21/14; B28B 21/18

[52] U.S. Cl. ..... 425/392; 249/179; 425/424; 425/432

[58] Field of Search ..... 425/62, 262, 424, 432, 425/443, 392-393; 249/100, 146, 153, 173, 179

[56] References Cited

U.S. PATENT DOCUMENTS

| | | | |
|---|---|---|---|
| 284,191 | 9/1883 | Dorsett | 249/100 |
| 1,710,919 | 4/1929 | Carr | 425/262 |
| 2,585,756 | 2/1952 | Eschenbrenner | 425/432 |
| 3,461,516 | 8/1969 | Boucher | 249/146 |
| 3,656,732 | 4/1972 | St. John | 249/179 |

FOREIGN PATENT DOCUMENTS

| | | | |
|---|---|---|---|
| 566,423 | 11/1958 | Canada | 425/262 |

*Primary Examiner*—Francis S. Husar
*Assistant Examiner*—John McQuade
*Attorney, Agent, or Firm*—McCormick, Paulding & Huber

[57] ABSTRACT

A method and apparatus for making concrete pipe and, more particularly, for the vibration treatment of concrete pipe for compaction and residual stress relief. A concrete pipe is formed within an external jacket employing a rotary packerhead method wherein the jacket is positioned vertically and the packerhead is moved progressively upwardly within the jacket rotating and distributing mix radially outwardly and troweling the internal surface of pipe under formation. On completion, the green pipe is removed from the pipe making machine and transported to and above a hollow vertically split and radially expandable and contractable cylinder. The pipe is lowered about the cylinder with the latter in a contracted condition, the cylinder is expanded into engagement with the pipe internal surface, and a vibrating means within the cylinder is actuated to vibrate the pipe throughout its length. The pipe is then returned to the pipe making machine, the packerhead is lowered, and a finish forming upward pass of the head deposits mix and/or trowels the pipe internal surface and fills any void which may have formed at the top of the pipe. The pipe is then removed from the machine and cured. The apparatus comprises the expandable and contractable cylinder, rollers mounted the same for intermittent relative rotation within the pipe, guide means at the top of the cylinder, fluid operable cylinders and an associated linkage within the cylinder for expanding and contracting the same, and a plurality of vibrators mounted within and on the cylinder wall.

3 Claims, 6 Drawing Figures

APPARATUS FOR MAKING CONCRETE PIPE

This is a division of application Ser. No. 547,333 Filed Feb. 5, 1975.

BACKGROUND OF THE INVENTION

While the vibration treatment of concrete pipe has been accomplished during pipe formation in the prior art, the mechanism for carrying out such treatment has been highly complex in construction and extremely expensive, as for example in U.S. Pat. No. 3,655,842 to Trautner entitled "Method of Vibrating Core in Concrete Pipe Making Machine". Further, there is an inherent limitation of such machinery in that a vibrating core follows a rotary packerhead upwardly in progress through the pipe and the vibration treatment must therefore constitute the final operation on the pipe internal surface prior to curing.

SUMMARY OF THE PRESENT INVENTION

It is the general object of the present invention to provide an improved apparatus for making concrete pipe and, more particularly, for the vibration treatment of green concrete pipe, the apparatus accommodating a final troweling or other finish forming operation on the pipe internal surface as distinguished from a final vibration operation on such surface.

DESCRIPTION OF PREFERRED EMBODIMENT

Figure 2:
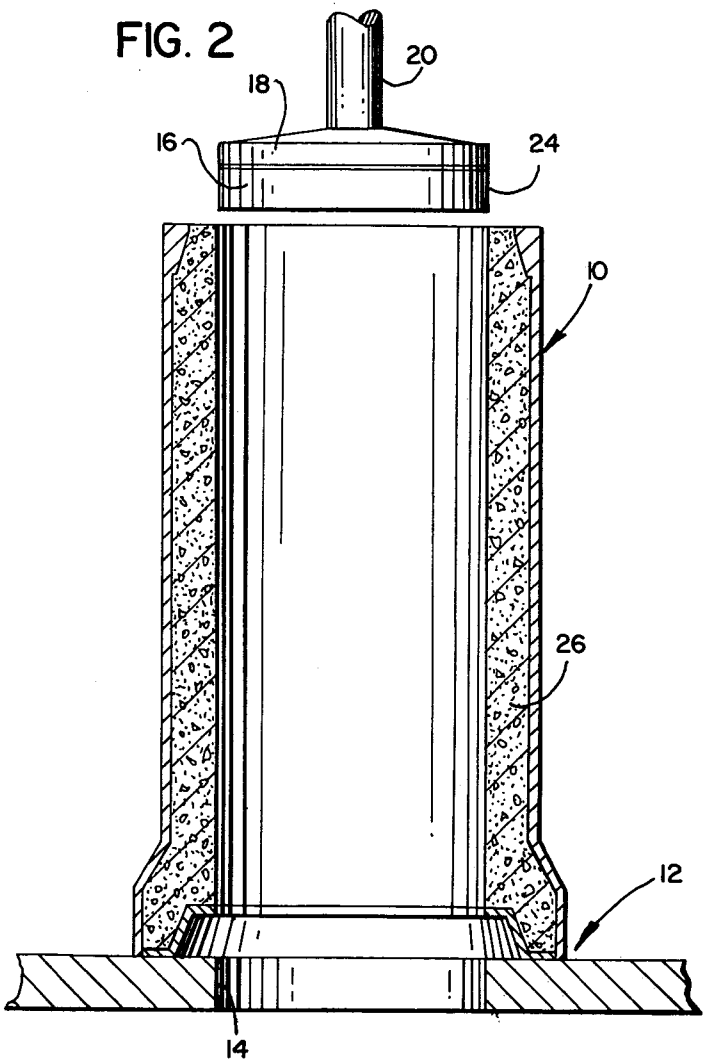
FIG. 2 is a somewhat schematic vertical sectional view as in FIG. 1 but with the rotary packerhead disposed above a completed pipe.

In accordance with the method disclosed herein, a concrete pipe is formed initially within an external mold or jacket and such forming may occur in a conventional rotary packerhead machine. Such a machine is illustrated schematically in FIGS. 1 and 2 and it will be observed that a pipe mold or jacket 10 is supported atop a base member 12 in the machine over a vertically extending opening 14. A rotary packerhead 16 can thus be lowered through the opening 14 and subsequently raised in coaxial relationship through the mold or jacket 10. Concrete "mix" or "mud" deposited atop the packerhead 16 is urged outwardly and downwardly thereabout by suitable vanes or the like 18. A vertical rod 20 may be suitably mounted and driven in the pipe making machine for rotation of the packerhead 16 and for raising and lowering of the same. The "mud" or "mix" may be delivered by conveyor means illustrated schematically at 22. As will be apparent, the "mud" or "mix" 26 disposed outwardly of the packerhead 16 is formed or troweled by the packerhead peripheral surface 24 as the packerhead moves progressively upwardly through the jacket 10. On completion of an upward stroke of the packerhead, a complete but uncured or "green" concrete pipe is provided within the jacket 10, FIG. 2. Pipes are formed conventionally with their bell ends facing downwardly and with spigot ends upwardly.

For details of construction and operation of a rotary packerhead type of pipe making machine, reference may be had to numerous prior art patents including the aforementioned Trautner Patent.

Figure 4:
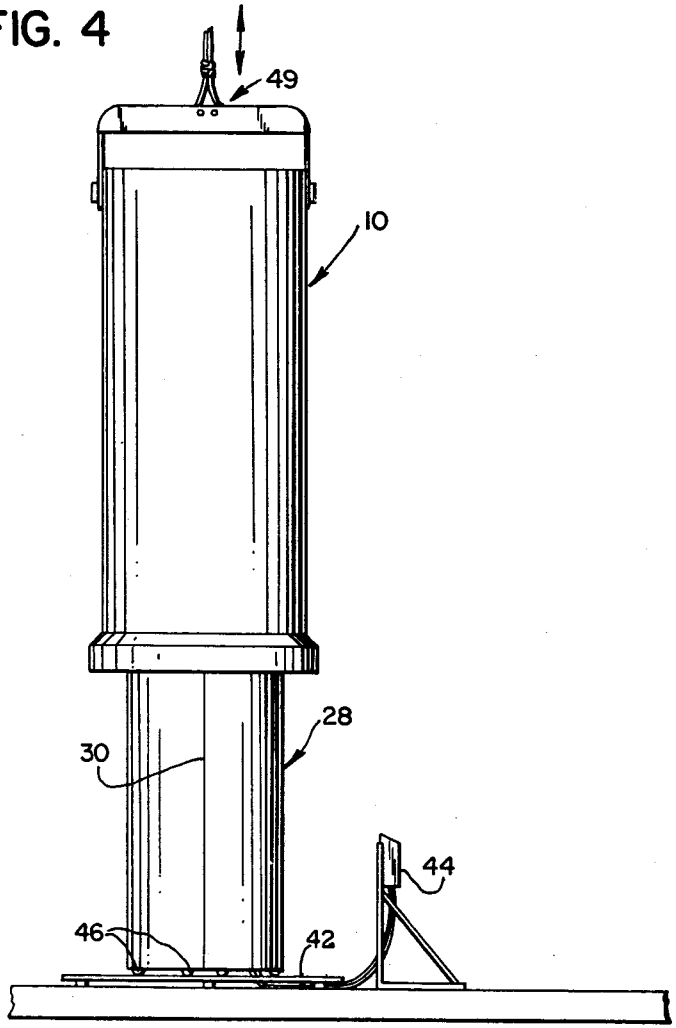
FIG. 4 shows the pipe vibrating apparatus of FIG. 3 with a green pipe and associated jacket partially lowered on and about the apparatus.
Figure 5:
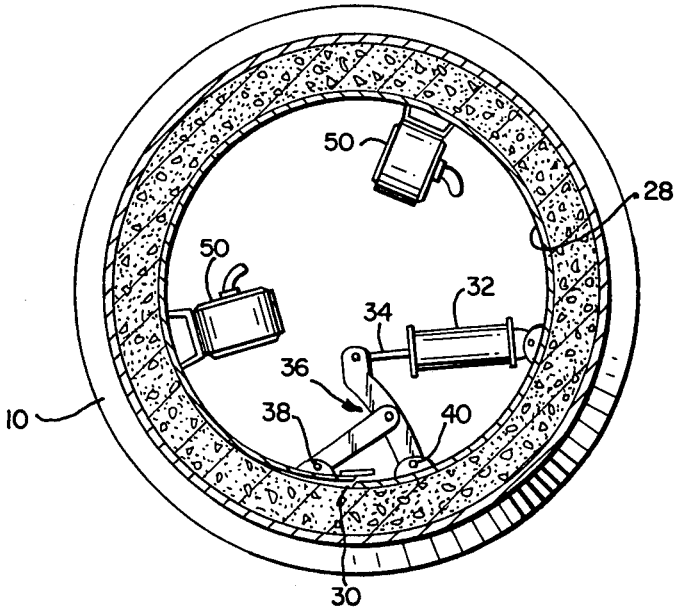
FIG. 5 is a top view of the apparatus of FIGS. 3 and 4 with a green pipe and associated jacket disposed thereabout, the expandable and contractable cylinder of the apparatus being in a contracted condition.
Figure 6:
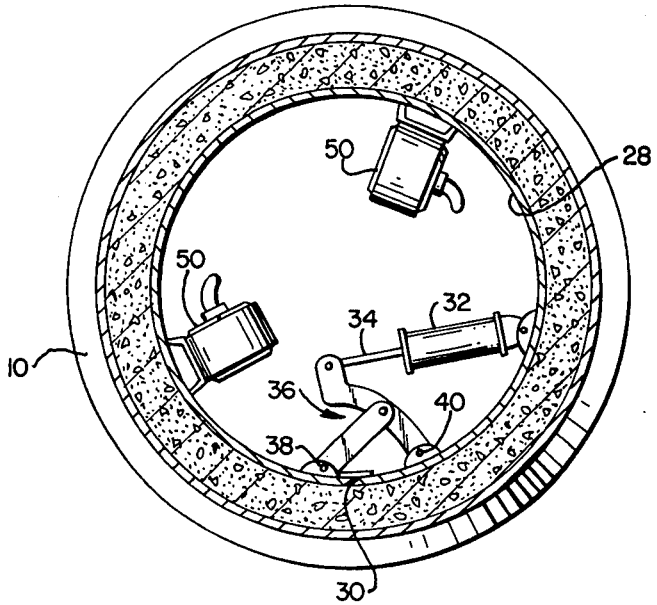
FIG. 6 is a view similar to FIG. 5 but with a cylinder in an expanded condition.

A second step of the method disclosed herein involves the provision of a radially expandable and contractable cylinder with an associated controllable vibrating means and which has an external diameter approximating the internal diameter of a green pipe requiring vibration treatment. Such a cylinder is illustrated at 28 in FIGS. 3 and 4 and it will be observed that the cylinder is of vertically split construction for radial expansion and contraction. Preferably, and as shown, the cylinder 28 has a single vertical split 30 and is of hollow steel construction open at the top and bottom. The steel is sufficiently flexible to permit diametrical or radial expansion and contraction and, as best illustrated in FIGS. 5 and 6, a fluid operable cylinder is provided at an upper end of the cylinder at 32 and a similar cylinder is disposed at a lower end of the cylinder, not shown. Each cylinder 32 has a rod 34 and an associated linkage 36 is connected at opposite sides of the split 30 at 38 and 40. Thus, the cylinders 32,32 can be operated selectively to open and close the split 30 and to expand and contract the hollow cylinder 28. Remote control of the cylinders 32,32 is provided for in accordance with the presently preferred practice, and lines running beneath a mounting plate 42, FIG. 3, extend from the cylinders to a control console 44. An operator of the apparatus may stand at the control console and it will be obvious that suitable valving can be provided together with manually operable controls to cause the cylinders to expand and contract the cylinder 28.

Figure 3:
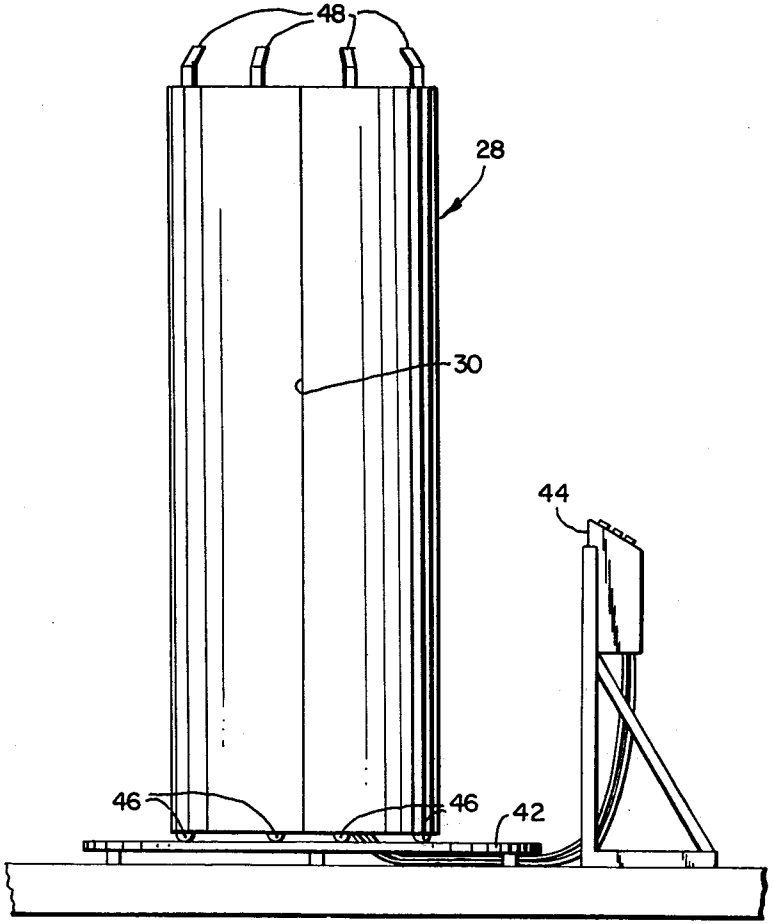
FIG. 3 is a somewhat schematic elevational view of a pipe vibrating apparatus constructed in accordance with the present invention.

Still referring to FIG. 3, it will be observed that small rollers 46, 46 are provided at a lower end portion. of the cylinder 28 and support the same atop the mounting plate 42. The rollers 46, 46 accommodate the expansion and contraction of the cylinder and, additionally, the said rollers serve to mount the cylinder for free rotation relative to a pipe mounted thereabout. As will be hereinafter apparent, incremental rotation of the cylinder may occur within a pipe during vibration treatment of the latter.

Still referring to FIG. 3, it will be observed that a plurality of upwardly and inwardly inclined guides 48, 48 are provided atop the hollow cylinder 28. The guides 48, 48 assist in the coaxial alignment of a green pipe as it is lowered on and about the cylinder 28, FIG. 4. Means for transporting a green pipe within its jacket 10 may vary widely within the scope of the invention and a simple hoist device as shown at 49 may be utilized. With the hollow cylinder 28 in a contracted condition, FIG. 5, the pipe and jacket 10 may be lowered thereabout as illustrated in FIG. 4. Thereafter, the fluid cylinder 32 and its counterpart may be operated to expand the cylinder 28 into engagement with the internal surface of the green pipe 26 as illustrated in FIG. 6.

With the cylinder 28 in engagement with the internal surface of the green pipe 26, a vibrating means is actuated whereby to vibrate the green pipe, to compact the same to eliminate voids and to relieve residual forming stresses. Vibrating means may vary widely within the scope of the invention but preferably comprises electric vibrators 50, 50 mounted on and within the cylinder 28 and remotely controllable at the console 44. That is, vibrators 50, 50 are connected by appropriate electrical conductors extending downwardly within the cylinder and beneath the plate 42 to the console 44 and operable and controllable therefrom. Two (2) vibrators are shown but various numbers and arrangements of vibrators can be provided within the scope of the invention.

The fluid cylinder 32 and its counterpart may be operated to urge the cylinder 28 radially outward into firm pressure engagement with the internal surface of the pipe 26 and a degree of further expansion of the cylinder 28 may occur during vibration whereby slightly to enlarge the internal diameter of the pipe. Alternatively, the pressure engagement of the cylinder 28 with the internal surface of the pipe may be such that little or no radial expansion of the cylinder 28 occurs during vibration but, in either event, it may be necessary or desirable to conduct a further and finish forming operation on the internal pipe surface. This may be true even though an incremental rotation of the cylinder 28 may occur during vibration as aforesaid. In any event, a highly desirable result is achieved when all features of the present invention are employed collectively.

Figure 1:
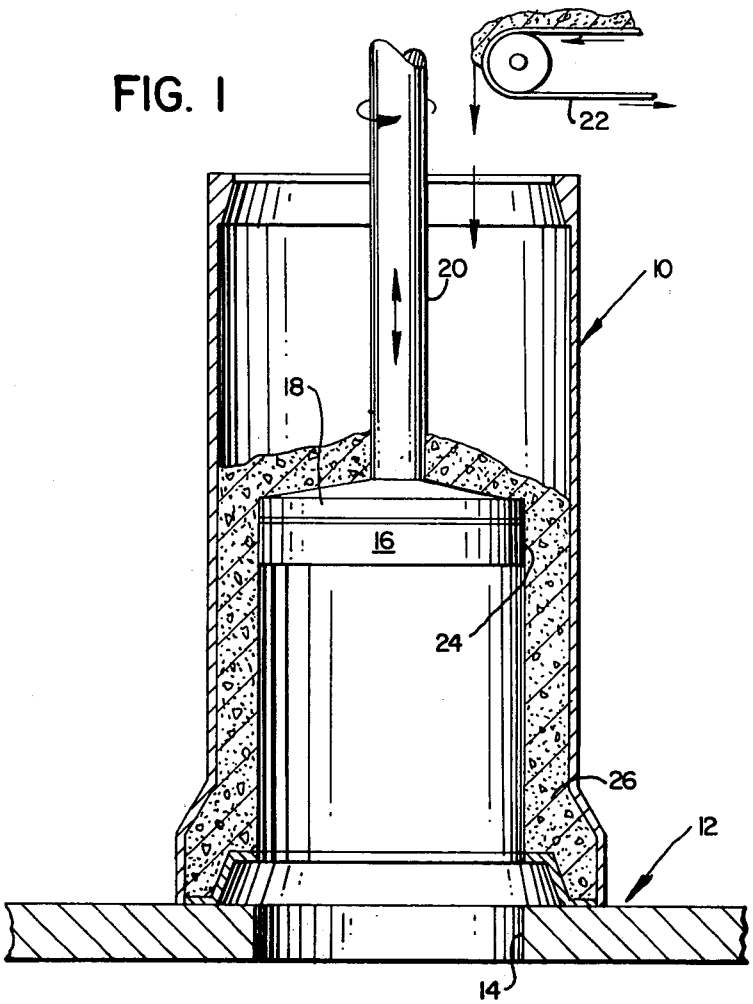
FIG. 1 is a somewhat schematic vertical sectional view showing a pipe jacket and a rotary packerhead of a pipe making machine, the rotary packerhead being shown at a position of partial pipe formation.

In conducting a further operation on the pipe subsequent to vibration treatment, the cylinder 28 is contracted by suitable operation of the fluid cylinder 32 and its counterpart, the pipe and its jacket 10 are lifted from the cylinder 28 and repositioned on the pipe making machine as illustrated in FIGS. 1 and 2. The packerhead 16 is thereupon lowered and a second or finish forming pass of the packerhead is accomplished. In its upward passage through the pipe, the packerhead may serve only to trowel the internal surface of the pipe or there may be an additional deposition of mix on the internal surface. In any event, an excellent internal finish of the pipe is achieved.

At an upper end portion of the green pipe, and during the vibration treatment, it will be apparent that a degree of sag or slump may occur. Thus, a small annular void may occur and, during the aforesaid finish forming operation, "mud" or "mix" will be deposited from the packerhead in said void and the void will be eliminated. Further treatments such as selective vibration of the bell and/or spigot end of the pipe may of course be carried out in accordance with conventional practice. When the pipe is thus completed, the pipe and its jacket may again be removed from the pipe making machine, transported to a curing station and deposited at the station in a conventional manner.

As will be apparent from the foregoing, the vibration treatment apparatus of the present invention is of relatively simple construction and can be expected to exhibit a high degree of ease and convenience in use, as well as dependability and durability in long service life. Excellent results are achieved in the compaction, elimination of voids and relief of residual stresses. Further, the internal surface of a pipe which is vibration treated in accordance with the method and apparatus of the present invention exhibits an improved internal finish condition together with the known advantages of vibration treatment.

We claim:

1. Apparatus for the vibration treatment of green concrete pipe comprising:

a. a cylindrical jacket within which the pipe is formed, b. a vertically split upright and hollow cylinder operatively associated with said jacket and expandable and contractable radially and having a diameter approximating the internal diameter of the pipe, upwardly and radially inwardly projecting guide means mounted at an upper end portion of said cylinder for guiding a pipe downwardly on and about the cylinder, means attached to and supporting said cylinder for rotation relative to a pipe thereabout, c. lift means operatively associated with the jacket for transporting the jacket and a green pipe therewithin to a position above said cylinder and for thereafter lowering and raising the jacket and pipe to and from a position about the cylinder with the latter contracted, d. means connected with the cylinder adjacent and on opposite sides of the vertical split for expanding the cylinder into engagement with the internal surface of a green pipe thereabout and for contracting the cylinder for vertical pipe movement relative to the cylinder as aforesaid by said lift means, e. at least one vibrator operatively associated with said cylinder for vibrating the same in an expanded condition and thereby vibrating a green pipe thereabout whereby to compact, to eliminate voids, and to relieve residual forming stresses in the latter, and horizontal support means operatively associated with the cylinder for engaging a pipe positioned about the cylinder at its lower end surface and for supporting the same independently of the cylinder and for thus accommodating incremental cylinder rotation relative to the pipe during said vibration.

2. Apparatus for the vibration treatment of green concrete pipe as set forth in claim 1 wherein said means attached to and supporting said cylinder for rotation takes the form of a plurality of freely rotatable support rollers.

3. Apparatus for the vibration treatment of green concrete pipe comprising:

a. a cylindrical jacket within which the pipe is adapted to be formed, b. a vertically split upright and hollow cylinder operatively associated with said jacket and expandable and contractable radially and having a diameter approximating the internal diameter of the pipe, guide means at one end portion of said cylinder for axially aligning a pipe and said cylinder, means attached to and supporting said cylinder for rotation relative to a pipe thereabout, c. means operatively associated with the jacket for transporting the jacket and a green pipe therewithin to a position adjacent said cylinder, relative axial movement thereafter being effected between the cylinder and the pipe and jacket to position the cylinder within the pipe with the cylinder in a contracted condition, d. means connected with the cylinder adjacent and on opposite sides of the vertical split for expanding the cylinder into engagement with the internal surface of a green pipe thereabout and for contracting the cylinder for vertical relative pipe and cylinder movement, e. at least one vibrator operatively associated with said cylinder for vibrating the same in an expanded condition and thereby vibrating a green pipe thereabout whereby to compact, to eliminate voids, and to relieve residual forming stresses in the latter, f. and horizontal support means operatively associated with said cylinder for engaging a pipe positioned about the cylinder at its lower end surface and for supporting the same independently of the cylinder and for thus accommodating incremental cylinder rotation relative to the pipe during said vibration.

* * * * *